US010612335B2

(12) United States Patent
Perez

(10) Patent No.: US 10,612,335 B2
(45) Date of Patent: Apr. 7, 2020

(54) CONTROLLED DISINTEGRATION OF DOWNHOLE TOOLS

(71) Applicant: Juan Carlos Flores Perez, The Woodlands, TX (US)

(72) Inventor: Juan Carlos Flores Perez, The Woodlands, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 260 days.

(21) Appl. No.: 15/685,159

(22) Filed: Aug. 24, 2017

(65) Prior Publication Data

US 2018/0100367 A1 Apr. 12, 2018

Related U.S. Application Data

(60) Provisional application No. 62/404,924, filed on Oct. 6, 2016.

(51) Int. Cl.
*E21B 29/02* (2006.01)
*E21B 41/00* (2006.01)

(52) U.S. Cl.
CPC ..... *E21B 29/02* (2013.01); *E21B 41/0085* (2013.01)

(58) Field of Classification Search
CPC ..... E21B 29/02; E21B 17/00; E21B 36/00; E21B 41/0085
See application file for complete search history.

(56) References Cited

U.S. PATENT DOCUMENTS

| | | | | |
|---|---|---|---|---|
| 8,528,633 | B2 | 9/2013 | Agrawal et al. | |
| 9,101,978 | B2 | 8/2015 | Xu et al. | |
| 2003/0201100 | A1* | 10/2003 | Al-Ramadhan | E21B 41/02 166/242.4 |
| 2013/0032357 | A1* | 2/2013 | Mazyar | E21B 41/00 166/376 |
| 2013/0333899 | A1* | 12/2013 | Xu | E21B 29/06 166/376 |

* cited by examiner

*Primary Examiner* — Zakiya W Bates
(74) *Attorney, Agent, or Firm* — Cantor Colburn LLP

(57) ABSTRACT

A downhole assembly comprises a disintegrable article comprising a metal, a metal alloy, a metal composite, or a combination comprising at least one of the foregoing; the disintegrable article being corrodible in a downhole fluid; a current source configured to supply electrons to the disintegrable article and to delay or reduce the corrosion of the disintegrable article in the downhole fluid; and
a controller configured to control the supply of electrons to the disintegrable article.

24 Claims, 5 Drawing Sheets

CONTROLLED DISINTEGRATION OF DOWNHOLE TOOLS

CROSS REFERENCE TO RELATED APPLICATIONS

This application claims the benefit of an earlier filing date from U.S. Provisional Application Ser. No. 62/404,924, filed Oct. 6, 2016, the entire disclosure of which is incorporated herein by reference.

BACKGROUND

Oil and natural gas wells often utilize wellbore components or tools that, due to their function, are only required to have limited service lives that are considerably less than the service life of the well. After a component or tool service function is complete, it must be removed or disposed of in order to recover the original size of the fluid pathway for use, including hydrocarbon production, $CO_2$ sequestration, etc. Disposal of components or tools has conventionally been done by milling or drilling the component or tool out of the wellbore, which are generally time consuming and expensive operations.

Recently, self-disintegrating or interventionless downhole tools have been developed. Instead of milling or drilling operations, these tools can be removed by dissolution of engineering materials using various wellbore fluids. Because downhole tools are often subject to high pressures, a disintegrable material with a high mechanical strength is often required to ensure the integrity of the downhole tools. In addition, the material must disintegrate at a slow rate initially so that the dimension and pressure integrities of the tools are maintained during tool service. Ideally the material can be degraded rapidly after the tool function is complete because the sooner the material disintegrates, the quicker the well can be put on production.

One challenge for the self-disintegrating or interventionless downhole tools is that the disintegration process can start as soon as the conditions in the well allow the corrosion reaction of the engineering material to start. Thus the disintegration period is not controllable as it is desired by the users but rather ruled by the well conditions and product properties. Therefore, the development of methods that are effective to delay or reduce the disintegration of the downhole tools so that they have the mechanical properties necessary to perform their intended function and then rapidly disintegrate in the presence of wellbore fluids is very desirable.

BRIEF DESCRIPTION

A downhole assembly comprises a disintegrable article comprising a metal, a metal alloy, a metal composite, or a combination comprising at least one of the foregoing; the disintegrable article being corrodible in a downhole fluid; a current source configured to supply electrons to the disintegrable article and to delay or reduce the corrosion of the disintegrable article in the downhole fluid; and a controller configured to control the supply of electrons to the disintegrable article.

A method of controllably removing a disintegrable article comprises disposing a disintegrable article comprising a metal, a metal alloy, a metal composite, or a combination comprising at least one of the foregoing in a downhole environment; supplying electrons to the disintegrable article by a current source; performing a downhole operation; terminating the supply of the electrons to the disintegrable article; and contacting the disintegrable article with a downhole fluid to corrode the article.

BRIEF DESCRIPTION OF THE DRAWINGS

The following descriptions should not be considered limiting in any way. With reference to the accompanying drawings, like elements are numbered alike.

DETAILED DESCRIPTION

The disclosure provides methods that are effective to delay or reduce the disintegration of various downhole tools during the service of the tools but can activate the disintegration process of the tools after the tools are no longer needed. The disclosure also provides a downhole assembly that contains a disintegrable article having a controlled disintegration profile.

In use, a current source is electrically coupled to the disintegrable articles forming one or more closed electric circuits which allow electric currents to flow through the disintegrable articles. The electric currents can supply electrons to the disintegrable articles thus delay, prevent, or reduce their disintegration. Once the disintegrable articles have completed their function, a controller can break the circuits thus terminating the supply of electrons to the disintegrable articles and activating the disintegration of the articles. The instructions to activate the disintegration process can be received above the ground or generated downhole using different parameters measured in real time, preprogrammed or commanded.

The methods allow for a full control of the disintegration period. The disintegrable articles can retain their physical properties until a signal or activation command is produced. Because the start of the disintegration process can be controlled, the disintegrable articles can be designed with an aggressive corrosion rate in order to accelerate the disintegration process once the articles are no longer needed.

Figure 1A:
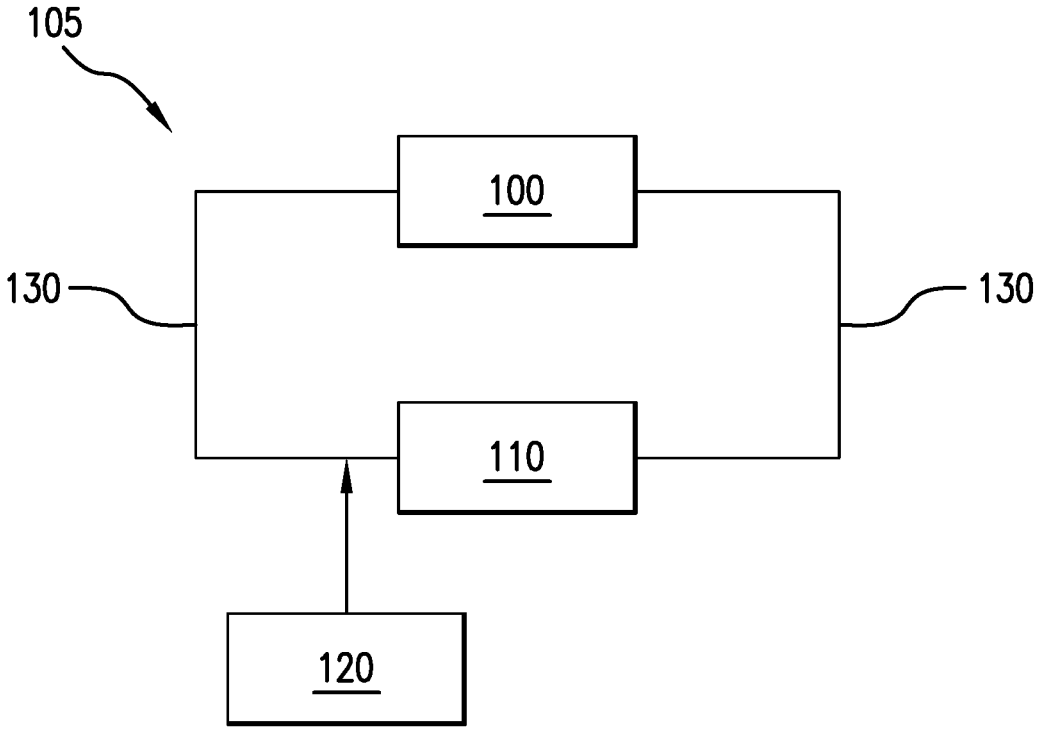
FIG. 1A is a schematic diagram of an exemplary downhole assembly that contains a disintegrable article having a controlled disintegration profile according to an embodiment of the disclosure.
Figure 1B:
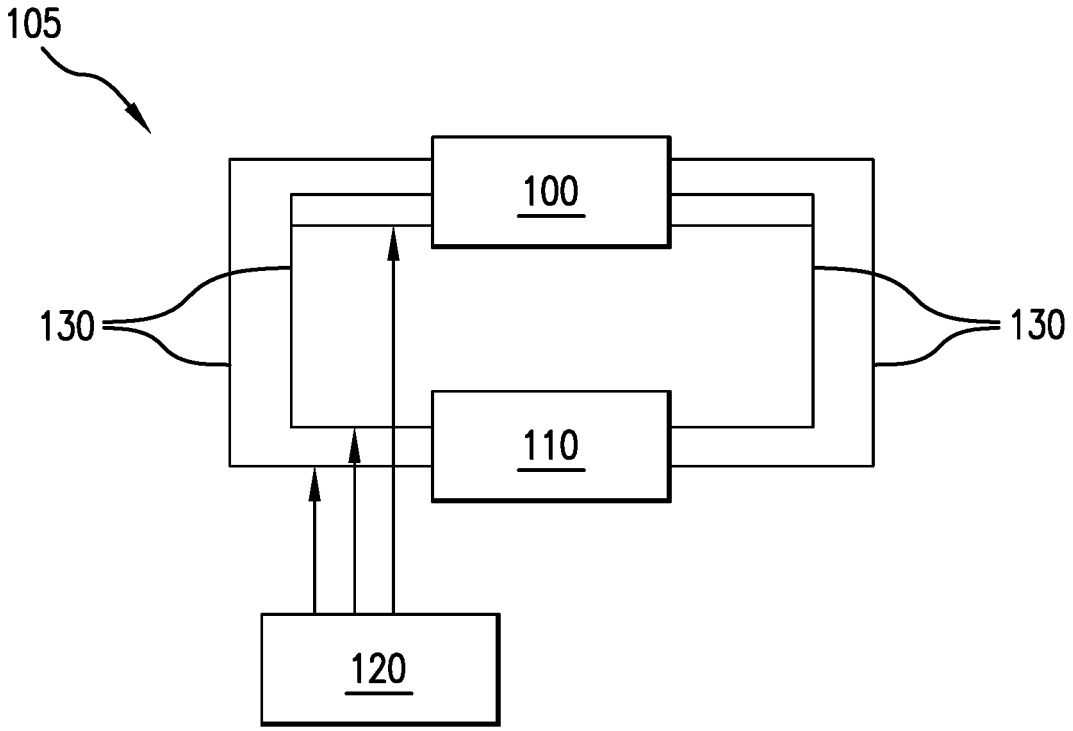
FIG. 1B is a schematic diagram of an exemplary downhole assembly that contains a disintegrable article having a controlled disintegration profile according to another embodiment of the disclosure.

Referring to FIGS. 1A to 1E, a downhole assembly 105 has a disintegrable article 100, a current source 110, and a controller 120, where the current source 110 is electrically coupled to the disintegrable article 100 via connecting wires 130 forming a closed electric circuit. By forming a closed circuit, the current source is effective to provide electrons to the disintegrable article 100. In an embodiment, the current source 110 and the disintegrable article 100 are coupled in an array pattern to enable the homogeneous supply of electrons to the surface of the disintegrable article. In other words, one or more current sources 110 can be used to form two or more electric circuits with the disintegrable article 100. An exemplary embodiment is shown in FIG. 1B.

The disintegrable article 100 comprises a metal, a metal alloy, a metal composite, or a combination comprising at least one of the foregoing. The disintegrable article is corrodible in a downhole fluid. The downhole fluid comprises water, brine, acid, or a combination comprising at least one of the foregoing. In an embodiment, the downhole fluid includes potassium chloride (KCl), hydrochloric acid (HCl), calcium chloride ($CaCl_2$), calcium bromide ($CaBr_2$) or zinc bromide ($ZnBr_2$), or a combination comprising at least one of the foregoing.

In an embodiment, the disintegrable article comprises Zn, Mg, Al, Mn, an alloy thereof, or a combination comprising at least one of the foregoing. The disintegrable article can further comprise Ni, W, Mo, Cu, Fe, Cr, Co, an alloy thereof, or a combination comprising at least one of the foregoing.

Magnesium alloy is specifically mentioned. Magnesium alloys suitable for use include alloys of magnesium with aluminum (Al), cadmium (Cd), calcium (Ca), cobalt (Co), copper (Cu), iron (Fe), manganese (Mn), nickel (Ni), silicon (Si), silver (Ag), strontium (Sr), thorium (Th), tungsten (W), zinc (Zn), zirconium (Zr), or a combination comprising at least one of these elements. Particularly useful alloys include magnesium alloy particles including those prepared from magnesium alloyed with Ni, W, Co, Cu, Fe, or other metals. Alloying or trace elements can be included in varying amounts to adjust the corrosion rate of the magnesium. For example, four of these elements (cadmium, calcium, silver, and zinc) have to mild-to-moderate accelerating effects on corrosion rates, whereas four others (copper, cobalt, iron, and nickel) have a still greater effect on corrosion. Exemplary commercial magnesium alloys which include different combinations of the above alloying elements to achieve different degrees of corrosion resistance include but are not limited to, for example, those alloyed with aluminum, strontium, and manganese such as AJ62, AJ50x, AJ51x, and AJ52x alloys, and those alloyed with aluminum, zinc, and manganese such as AZ91A-E alloys.

The magnesium alloys are useful for forming the disintegrable article and are formed into the desired shape and size by casting, forging and machining. Alternatively, powders of Zn, Mg, Al, Mn, an alloy thereof, or a combination are useful for forming the disintegrable article. The powder generally has a particle size of from about 50 to about 150 micrometers, and more specifically about 60 to about 140 micrometers. The powder can be further coated using a method such as chemical vapor deposition, anodization or the like, or admixed by physical method such cryo-milling, ball milling, or the like, with a metal or metal oxide such as Al, Ni, W, Co, Cu, Fe, oxides of one of these metals, or the like. The coating layer can have a thickness of about 25 nm to about 2,500 nm. Al/Ni and Al/W are specific examples for the coating layers. More than one coating layer may be present. Additional coating layers can include Al, Zn, Mg, Mo, W. Cu, Fe, Si, Ca, Co, Ta, Re, or No. Such coated magnesium powders are referred to herein as controlled electrolytic materials (CEM). The CEM materials are then molded or compressed into the desired shape by, for example, cold compression using an isostatic press at about 40 to about 80 ksi (about 275 to about 550 MPa), followed by forging or sintering and machining, to provide a desired shape and dimensions of the disintegrable article. The CEM materials including the composites formed therefrom have been described in U.S. Pat. Nos. 8,528,633 and 9,101,978.

It will be understood that the magnesium alloys, including CEM materials, will thus have any corrosion rate necessary to achieve the desired performance of the disintegrable article once the article completes its function. In a specific embodiment, the magnesium alloy or CEM material used to form the disintegrable article has a corrosion rate of about 0.1 to about 450 $mg/cm^2$/hour, specifically about 1 to about 450 $mg/cm^2$/hour determined in aqueous 3 wt. % KCl solution at 200° F. (93° C.).

Optionally, the disintegrable article further comprises additional materials such as carbides, nitrides, oxides, precipitates, dispersoids, glasses, carbons, or the like in order to control the mechanical strength and density of the disintegrable article.

The current source 110 provides electrons to the disintegrable article 100 thus delaying, preventing, or reducing the corrosion of the disintegrable article in the downhole fluid during the service of the article. In an embodiment, the current source 110 provides direct current voltage. The current source 110 can be a battery, a device effective to generate an electric current in situ in a downhole environment, or a combination thereof. In an embodiment, the current source 110 is a battery placed downhole or at the surface, and electrically connected to the disintegrable article 100.

Figure 1C:
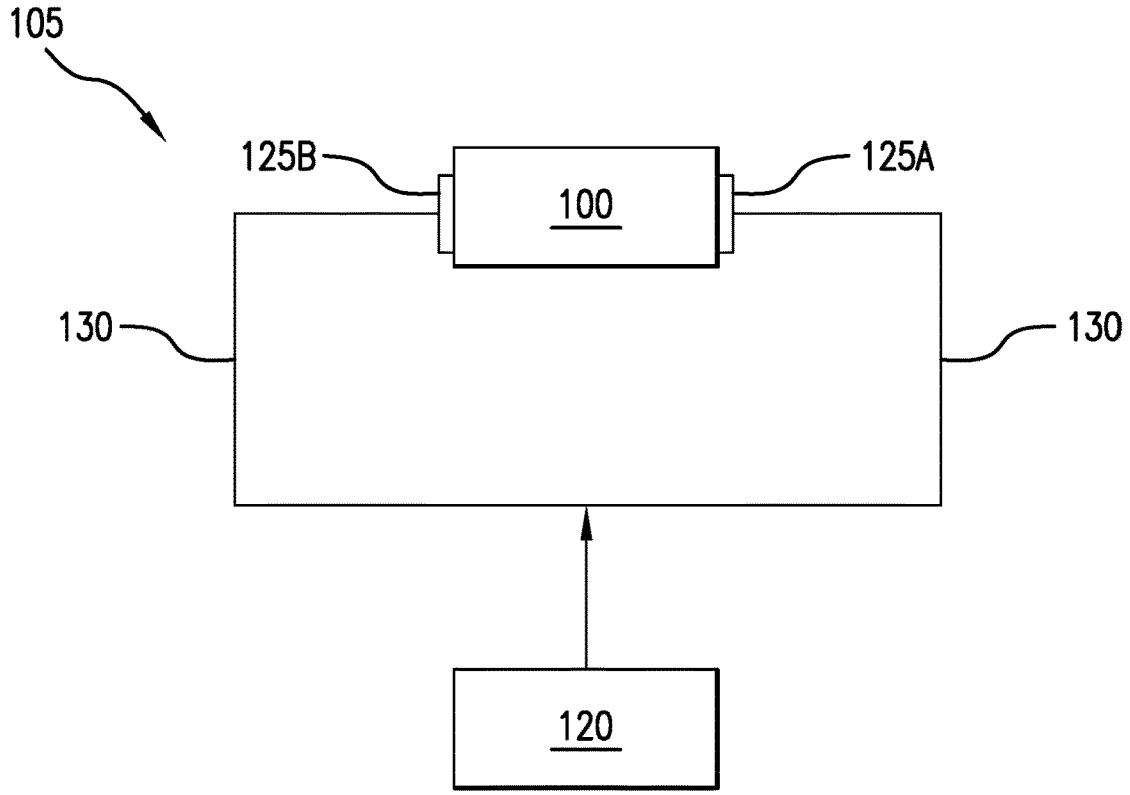
FIG. 1C is a schematic diagram of an exemplary downhole assembly that contains a disintegrable article having a controlled disintegration profile according to another embodiment of the disclosure.

The device effective to generate an electric current in situ is not particularly limited. For example, as shown in FIG. 1C, the downhole assembly 105 can have two conductive metals/metal alloys 125A and 125B disposed on two surfaces of the disintegrable article 100. The two conductive metals/metal alloys have different galvanic reactivity. When these dissimilar metals/metal alloys 125A and 125B are brought into electrical contact via connecting wires 130 in the presence of an electrolyte (not shown), an electrochemical potential is generated, thus providing electrons to the disintegrable article 100. The greater the difference in corrosion potential between the dissimilar metals, the greater the electrical potential generated.

The controller 120 is connected, at least electrically, to the electric circuit formed from the current source 110 and the disintegrable article 100 and controls the supply of electrons to the disintegrable article 100 according to instructions received above the ground or generated downhole. Controlling the supply of electrons comprises terminating the supply of electrons to the disintegrable article. Such operations can be achieved by breaking the circuits formed between the current source 110 and the disintegration article 100.

The controller 120 uses circuits to control the supply of electrons to the disintegrable article 100. Controller 120 may also contain a processor having memory storage for storing operating instructions and storing data from sensors, if present in the downhole assembly. Controller may also have RF telemetry capability for transmitting data to, and/or receiving instructions from, remote stations.

In an embodiment, the instructions to activate the disintegration process can be pre-programmed. For example, the controller 120 can automatically break the circuit after a per-determined period of time. In another embodiment, the controller 120 responds to user commands entered through a suitable device, such as a keyboard or a touch screen 150.

Figure 1D:
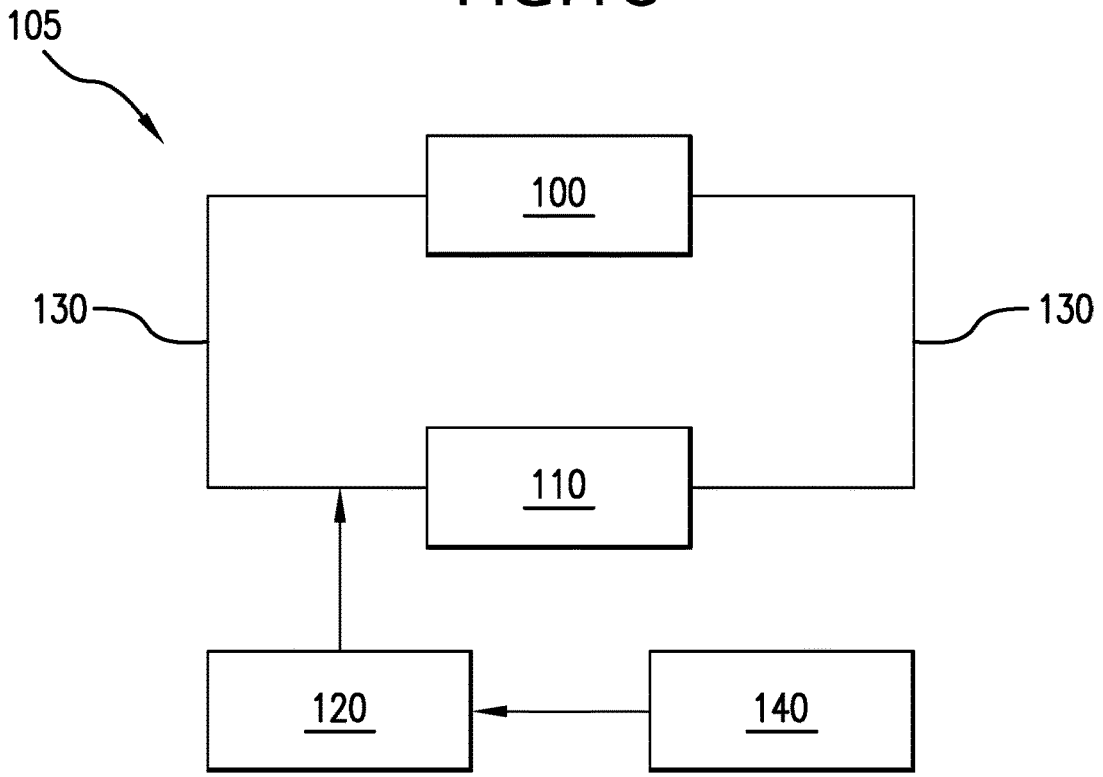
FIG. 1D is a schematic diagram of an exemplary downhole assembly that contains a disintegrable article having a controlled disintegration profile according to yet another embodiment of the disclosure.
Figure 1E:
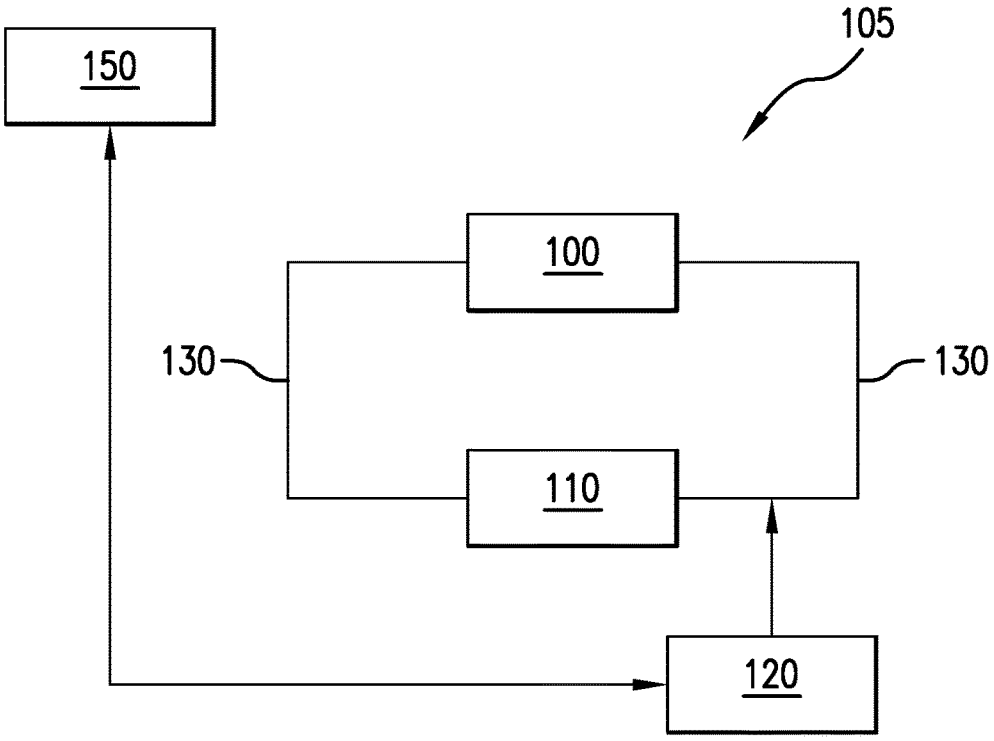
FIG. 1E is a schematic diagram of an exemplary downhole assembly that contains a disintegrable article having a controlled disintegration profile according to still another embodiment of the disclosure.

In some embodiments, the downhole assembly 105 further comprises a sensor 140 as shown in FIG. 1D operatively coupled to the controller 120 for providing at least one parameter of interest related to the activation of the disintegration process. The data generated by sensor 140 is processed by a processor in the controller (not shown). An instruction is produced if the measured value of the parameter meets a preset threshold value. The parameter can be temperature, pressure, pH, or a combination thereof.

Disintegrable articles in the downhole assembly are not particularly limited. Exemplary articles include a ball, a ball seat, a fracture plug, a bridge plug, a wiper plug, shear out plugs, a debris barrier, an atmospheric chamber disc, a swabbing element protector, a sealbore protector, a screen protector, a beaded screen protector, a screen basepipe plug, a drill in stim liner plug, ICD plugs, a flapper valve, a gaslift valve, a transmatic CEM plug, float shoes, darts, diverter balls, shifting/setting balls, ball seats, sleeves, teleperf disks, direct connect disks, drill-in liner disks, fluid loss control flappers, shear pins or screws, cementing plugs, teleperf plugs, drill in sand control beaded screen plugs, HP beaded frac screen plugs, hold down dogs and springs, a seal bore protector, a stimcoat screen protector, or a liner port plug. In specific embodiments, the disintegrable article is a ball, a fracture plug, a whipstock, a cylinder, or a liner plug.

Figure 2:
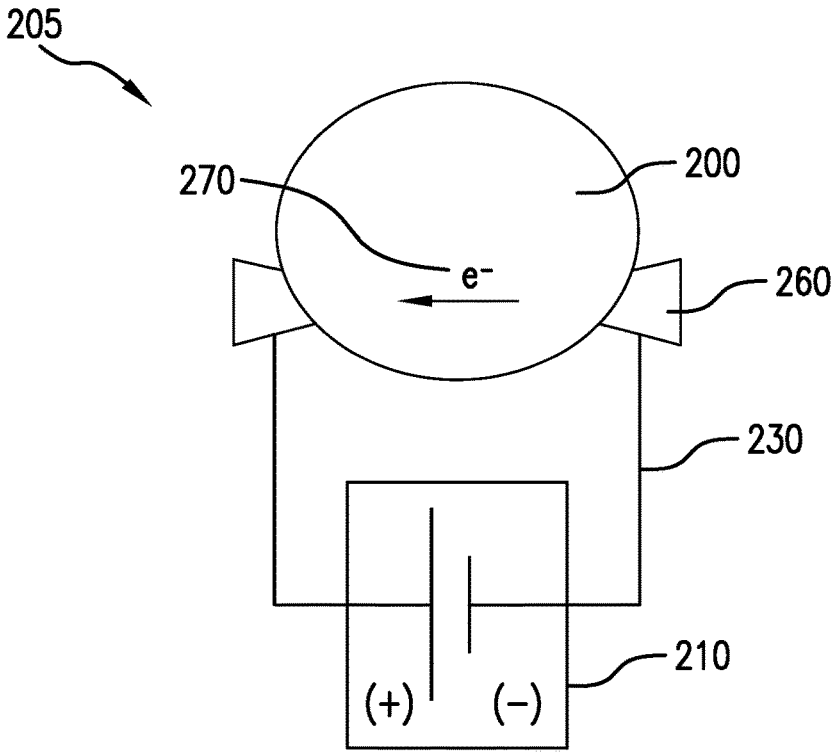
FIG. 2 illustrates a downhole assembly that includes a ball, a ball seat, and a current source according to an embodiment of the disclosure.
Figure 3:
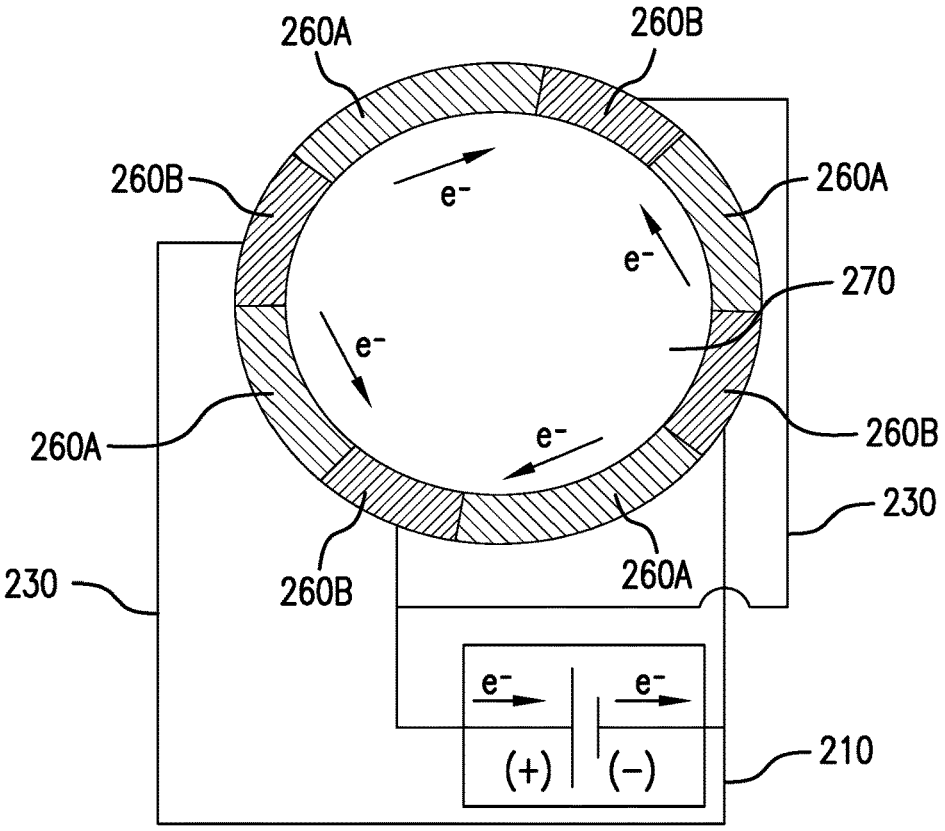
FIG. 3 illustrates the ball seat shown in FIG. 2.

FIG. 2 illustrates a downhole assembly 205 having a ball 200, a ball seat 260, and a current source 210, where the ball seat 260 is electrically coupled to the ball 200 via conducting wires 230. FIG. 3 illustrates the ball seat 260 shown in FIG. 2. The ball seat 260 has alternating conductive portions 260B and non-conductive portions 260A. The current source 210 is coupled to the conductive portions 260B of the ball seat 260. The current source 210 forms a number of circuits with the conductive portions of the ball seat 260 and the ball 200. The circuits uniformly provide electrons 270 to the ball 200. It is contemplated that if the ball seat 260 does not have alternating conductive and non-conductive portions, very limited electrons may be supplied to the ball 200.

Figure 4:
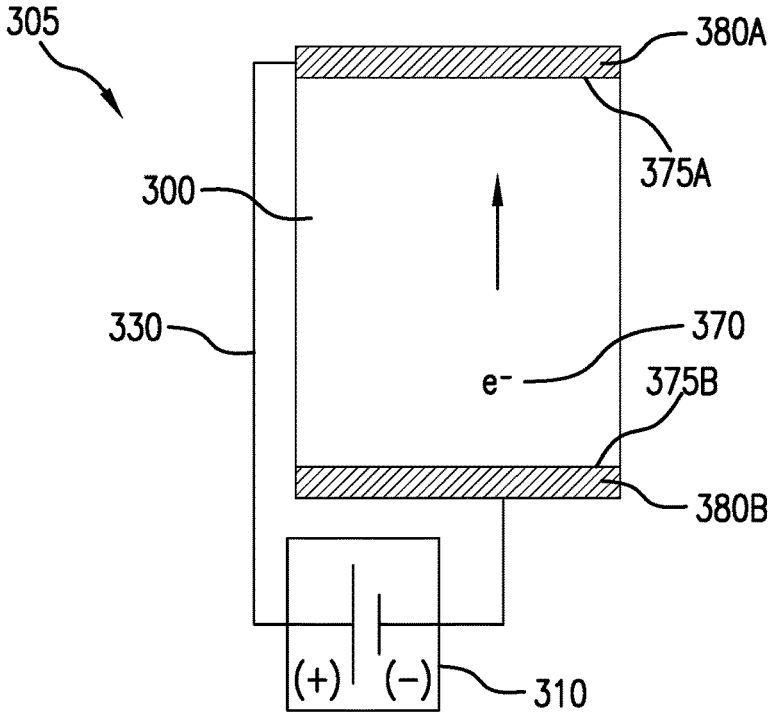
FIG. 4 illustrates a downhole assembly containing a disintegrable article having two opposing surfaces coupled to a current source.

FIG. 4 illustrates a downhole assembly 305 containing a disintegrable article 300 having two opposing surfaces 375A and 375B coupled to a current source 310. As shown in FIG. 4, the downhole assembly can further include a first conductive metal or metal alloy 380A disposed on the first surface of the disintegrable article, and a second conductive metal or metal alloy 380B disposed on the second surface of the disintegrable article. The current source 310 provides electrons 370 to the disintegrable article 300 by forming a closed electric circuit with the disintegrable article 300 via conducting wires 330.

Figure 5:
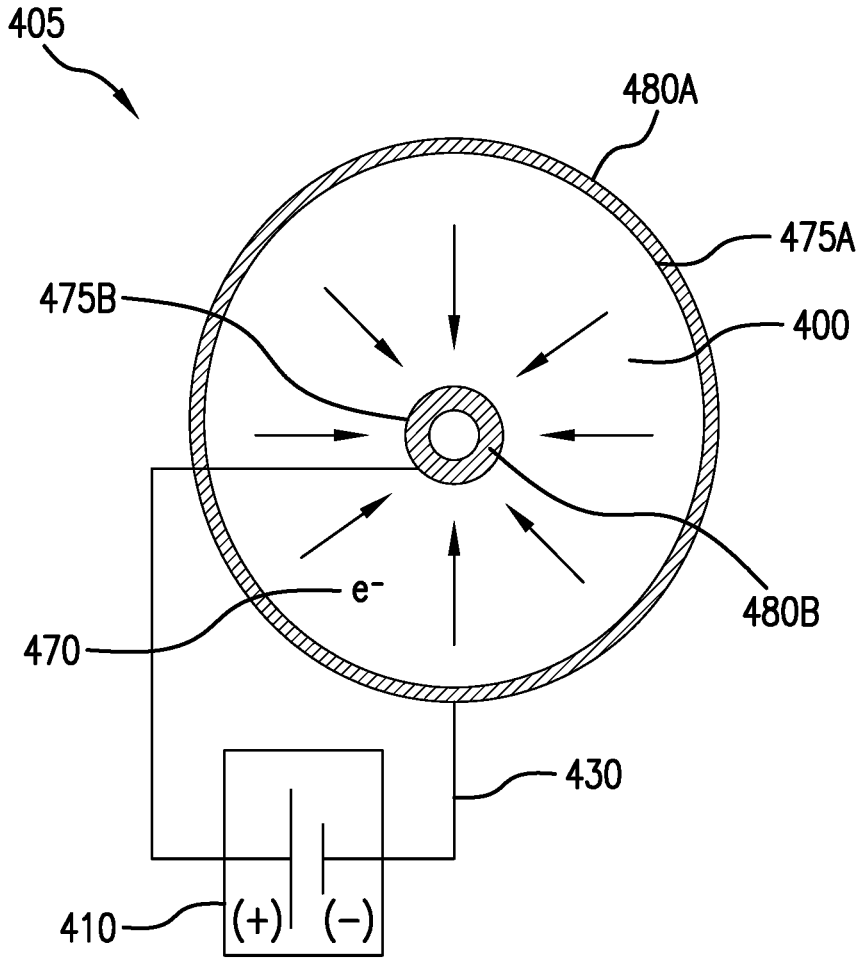
FIG. 5 illustrates a downhole assembly containing a tubular-shaped disintegrable article having inner and outer surfaces coupled to a current source.

FIG. 5 illustrates a downhole assembly 405 containing a tubular shaped disintegrable article 400 having an inner surface 475B and an outer surface 475A coupled to a current source 410. In FIG. 5, the inner surface 475B and the outer surface 475A of the disintegrable article 400 are coupled to current source 410 via a first conductive metal or metal alloy 480B and a second metal or metal alloy 480A, and conducting wires 430. The current source is effective to provide electrons 470 to the disintegrable article 400 thus delaying, preventing, or reducing the disintegration of the article 400 while the article is in use.

Any conductive metal or metal alloy known in the art can be used. The first and second conductive metal/metal alloy can be made of the same or different material, and they are in form of a plate, a coating, or a combination thereof. Any known methods to deposit to coat the first and second conductive metal/metal alloy on the disintegrable article can be used.

The disintegrable articles in the downhole assemblies disclosed herein can be controllably removed such that significant disintegration only occurs after these articles have completed their functions. A method of controllably removing a disintegrable article comprises disposing a disintegrable article comprising a metal, a metal alloy, a metal composite, or a combination comprising at least one of the foregoing in a downhole environment; supplying electrons to the disintegrable article by a current source; performing a downhole operation; terminating the supply of the electrons to the disintegrable article; and contacting the disintegrable article with a downhole fluid to disintegrate the article.

Supplying electrons to the disintegrable article can be achieved by forming one or more closed circuits by electrically connecting the disintegrable article with a current source. If a specific exemplary assembly as illustrated in FIGS. 2 and 3, the method further comprise disposing the ball on the ball seat, and supplying electrons to the ball via the ball seat.

Electrons are continuously supplied to the disintegrable article during the service life of the article. A downhole operation is performed, which can be any operation that is performed during drilling, stimulation, completion, production, or remediation.

Once the disintegrable article is no longer needed, the supply of electrons to the disintegrable article is terminated, and the disintegration of the article is activated. The method can further comprise receiving an instruction from above the ground or generating an instruction downhole to terminate the supply of the electrons. In the event that the downhole assembly contains a sensor, the method further comprises measuring a value of a parameter of interest related to the disintegration of the disintegrable article, and generating an instruction by comparing the measured value of the parameter with a threshold value. If the measured value meets the threshold value, then an instruction can be generated and processed by the controller, which in turn terminates the supply of the electrons to the disintegrable article by breaking the circuit formed between the current source and the disintegrable article. Without external supply of electrons to the article, the article can rapidly disintegrate in the presence of a downhole fluid as described herein.

Set forth below are various embodiments of the disclosure.

Embodiment 1

A downhole assembly comprising: a disintegrable article comprising a metal, a metal alloy, a metal composite, or a combination comprising at least one of the foregoing; the disintegrable article being corrodible in a downhole fluid; a current source configured to supply electrons to the disintegrable article and to delay or reduce the corrosion of the disintegrable article in the downhole fluid; and a controller configured to control the supply of electrons to the disintegrable article.

Embodiment 2

The downhole assembly of claim 1, wherein the disintegrable article comprises Zn, Mg, Al, Mn, an alloy thereof, or a combination comprising at least one of the foregoing.

Embodiment 3

The downhole assembly of claim 2, wherein the disintegrable article further comprises Ni, W, Mo, Cu, Fe, Cr, Co, an alloy thereof, or a combination comprising at least one of the foregoing.

Embodiment 4

The downhole assembly of any one of claims 1 to 3, wherein current source comprises a battery, a device effective to generate an electric current in situ in a downhole environment, or a combination thereof.

Embodiment 5

The downhole assembly of any one of claims 1 to 4, wherein the controller controls the supply of electrons to the disintegrable article according to an instruction received above the ground or generated downhole.

Embodiment 6

The downhole assembly of any one of claims 1 to 5, further comprising a sensor operatively coupled to the controller for providing at least one parameter of interest related to the corrosion of the disintegrable article.

Embodiment 7

The downhole assembly of any one of claims 1 to 6, wherein controlling the supply of electrons comprises terminating the supply of electrons to the disintegrable article.

Embodiment 8

The downhole assembly of any one of claims 1 to 7, wherein the downhole fluid comprises water, brine, acid, or a combination comprising at least one of the foregoing.

Embodiment 9

The downhole assembly of any one of claims 1 to 8, wherein the disintegrable article is a ball, a ball seat, a fracture plug, a bridge plug, a wiper plug, shear out plugs, a debris barrier, an atmospheric chamber disc, a swabbing element protector, a sealbore protector, a screen protector, a beaded screen protector, a screen basepipe plug, a drill in stim liner plug, an ICD plug, a flapper valve, a gaslift valve, a transmatic CEM plug, float shoes, a dart, a diverter ball, a shifting/setting ball, a ball seat, a sleeve, a teleperf disk, a direct connect disk, a drill-in liner disk, a fluid loss control flapper, a shear pin or screw, a cementing plug, a teleperf plug, a drill in sand control beaded screen plug, a HP beaded frac screen plug, a hold down dog and spring, a seal bore protector, a stimcoat screen protector, or a liner port plug.

Embodiment 10

The downhole assembly of any one of claims 1 to 9, wherein the disintegrable article is a ball; and the downhole assembly further comprises a ball seat.

Embodiment 11

The downhole assembly of claim 10, wherein: the ball seat comprises alternating conductive and non-conductive portions; and the current source is coupled to the conductive portions of the ball seat separated by non-conductive portions.

Embodiment 12

The downhole assembly of any one of claims claims 1 to 9, wherein the disintegrable article comprises a first surface and a second surface different from the first surface, and the current source is coupled to the first and second surfaces of the disintegrable article.

Embodiment 13

The downhole assembly of claim 12, further comprising a first conductive metal or metal alloy disposed on the first surface of the disintegrable article, and a second conductive metal or metal alloy disposed on the second surface of the disintegrable article.

Embodiment 14

A method of controllably removing a disintegrable article, the method comprising: disposing a disintegrable article comprising a metal, a metal alloy, a metal composite, or a combination comprising at least one of the foregoing in a downhole environment; supplying electrons to the disintegrable article by a current source; performing a downhole operation; terminating the supply of the electrons to the disintegrable article; and contacting the disintegrable article with a downhole fluid to corrode the article.

Embodiment 15

The method of claim 14, wherein supplying the electrons to the disintegrable article comprises homogeneously proving electrons to the disintegrable article.

Embodiment 16

The method of claim 14 or claim 15, wherein the disintegrable article comprises Zn, Mg, Al, Mn, an alloy thereof, or a combination comprising at least one of the foregoing.

Embodiment 17

The method of any one of claims 14-16, wherein the disintegrable article further comprises Ni, W, Mo, Cu, Fe, Cr, Co, an alloy thereof, or a combination comprising at least one of the foregoing.

Embodiment 18

The method of any one of claims 14 to 17, wherein the current source comprises a battery, a device effective to generate an electric current in situ in a downhole environment, or a combination thereof.

Embodiment 19

The method of any one of claims 14 to 18, further comprising receiving an instruction from above the ground or generating an instruction downhole to terminate the supply of the electrons to the disintegrable article.

Embodiment 20

The method of any one of claims 14 to 19, further comprising measuring a value of a parameter of interest related to the corrosion of the disintegrable article; and generating an instruction by comparing the measured value of the parameter with a threshold value.

Embodiment 21

The method of any one of claims 14 to 20, wherein the parameter comprises temperature, pressure, pH, or a combination thereof.

Embodiment 22

The method of any one of claims 14 to 21, wherein the disintegrable article is a ball; and the method further comprises disposing the ball on a ball seat, the ball seat having alternating conductive and non-conductive portions.

Embodiment 23

The method of claim 22, wherein the electrons are provided to the ball via the ball seat.

Embodiment 24

The method of any one of claims 14 to 23, wherein the disintegrable article comprises a first conductive metal or metal alloy disposed on a first surface of the disintegrable article, and a second conductive metal or metal alloy disposed on the second surface of the disintegrable article, and the electrons are provided to the disintegrable article via the first and second conductive metals or metal alloys.

All ranges disclosed herein are inclusive of the endpoints, and the endpoints are independently combinable with each other. As used herein, "combination" is inclusive of blends, mixtures, alloys, reaction products, and the like. All references are incorporated herein by reference in their entirety.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity).

What is claimed is:

1. A downhole assembly comprising:

a disintegrable article comprising a metal, a metal alloy, a metal composite, or a combination comprising at least one of the foregoing; the disintegrable article being corrodible in a downhole fluid;

a current source configured to supply electrons to the disintegrable article and to delay or reduce the corrosion of the disintegrable article in the downhole fluid; and a controller configured to control the supply of electrons to the disintegrable article, wherein the disintegrable article comprises Zn, Mg, Al, Mn, an alloy thereof, or a combination comprising at least one of the foregoing, and the disintegrable article further comprises Ni, W, Mo, Cu, Fe, Cr, Co, an alloy thereof, or a combination comprising at least one of the foregoing.

2. The downhole assembly of claim 1, wherein current source comprises a battery, a device effective to generate an electric current in situ in a downhole environment, or a combination thereof.

3. The downhole assembly of claim 1, wherein the controller controls the supply of electrons to the disintegrable article according to an instruction received above the ground or generated downhole.

4. The downhole assembly of claim 1, wherein controlling the supply of electrons comprises terminating the supply of electrons to the disintegrable article.

5. The downhole assembly of claim 1, wherein the downhole fluid comprises water, brine, acid, or a combination comprising at least one of the foregoing.

6. The downhole assembly of claim 1, wherein the disintegrable article is a ball, a ball seat, a fracture plug, a bridge plug, a wiper plug, shear out plugs, a debris barrier, an atmospheric chamber disc, a swabbing element protector, a sealbore protector, a screen protector, a beaded screen protector, a screen basepipe plug, a drill in stim liner plug, an inflow control device (ICD) plug, a flapper valve, a gaslift valve, a transmatic controlled electrolytic material (CEM) plug, float shoes, a dart, a diverter ball, a shifting/setting ball, a ball seat, a sleeve, a teleperf disk, a direct connect disk, a drill-in liner disk, a fluid loss control flapper, a shear pin or screw, a cementing plug, a teleperf plug, a drill in sand control beaded screen plug, a HP beaded frac screen plug, a hold down dog and spring, a seal bore protector, a stimcoat screen protector, or a liner port plug.

7. The downhole assembly of claim 1, wherein the disintegrable article is a ball; and the downhole assembly further comprises a ball seat.

8. The downhole assembly of claim 7, wherein the disintegrable article comprises a first surface and a second surface different from the first surface, and the current source is coupled to the first and second surfaces of the disintegrable article.

9. The downhole assembly of claim 8, further comprising a first conductive metal or metal alloy disposed on the first surface of the disintegrable article, and a second conductive metal or metal alloy disposed on the second surface of the disintegrable article.

10. A downhole assembly comprising:

a disintegrable article comprising a metal, a metal alloy, a metal composite, or a combination comprising at least one of the foregoing; the disintegrable article being corrodible in a downhole fluid;

a current source configured to supply electrons to the disintegrable article and to delay or reduce the corrosion of the disintegrable article in the downhole fluid;

a controller configured to control the supply of electrons to the disintegrable article; and a sensor operatively coupled to the controller for providing at least one parameter of interest related to the corrosion of the disintegrable article.

11. The downhole assembly of claim 10, wherein the disintegrable article comprises Zn, Mg, Al, Mn, an alloy thereof, or a combination comprising at least one of the foregoing.

12. The downhole assembly of claim 11, wherein the disintegrable article further comprises Ni, W, Mo, Cu, Fe, Cr, Co, an alloy thereof, or a combination comprising at least one of the foregoing.

13. A downhole assembly comprising:

a disintegrable article comprising a metal, a metal alloy, a metal composite, or a combination comprising at least one of the foregoing; the disintegrable article being corrodible in a downhole fluid;

a current source configured to supply electrons to the disintegrable article and to delay or reduce the corrosion of the disintegrable article in the downhole fluid; and a controller configured to control the supply of electrons to the disintegrable article;

wherein:

the disintegrable article is a ball;

the downhole assembly further comprises a ball seat;

the ball seat comprises alternating conductive and non-conductive portions; and the current source is coupled to the conductive portions of the ball seat separated by non-conductive portions.

14. A method of controllably removing a disintegrable article, the method comprising:

disposing a disintegrable article comprising a metal, a metal alloy, a metal composite, or a combination comprising at least one of the foregoing in a downhole environment;

supplying electrons to the disintegrable article by a current source;

performing a downhole operation;

terminating the supply of the electrons to the disintegrable article; and contacting the disintegrable article with a downhole fluid to corrode the article.

15. The method of claim 14, wherein supplying the electrons to the disintegrable article comprises homogeneously proving electrons to the disintegrable article.

16. The method of claim 14, wherein the disintegrable article comprises Zn, Mg, Al, Mn, an alloy thereof, or a combination comprising at least one of the foregoing.

17. The method of claim 16, wherein the disintegrable article further comprises Ni, W, Mo, Cu, Fe, Cr, Co, an alloy thereof, or a combination comprising at least one of the foregoing.

18. The method of claim 14, wherein the current source comprises a battery, a device effective to generate an electric current in situ in a downhole environment, or a combination thereof.

19. The method of claim 14, further comprising receiving an instruction from above the ground or generating an instruction downhole to terminate the supply of the electrons to the disintegrable article.

20. The method of claim 14, further comprising measuring a value of a parameter of interest related to the corrosion of the disintegrable article; and generating an instruction by comparing the measured value of the parameter with a threshold value.

21. The method of claim 20, wherein the parameter comprises temperature, pressure, pH, or a combination thereof.

22. The method of claim 14, wherein the disintegrable article is a ball; and the method further comprises disposing the ball on a ball seat, the ball seat having alternating conductive and non-conductive portions.

23. The method of claim 22, wherein the electrons are provided to the ball via the ball seat.

24. The method of claim 14, wherein the disintegrable article comprises a first conductive metal or metal alloy disposed on a first surface of the disintegrable article, and a second conductive metal or metal alloy disposed on the second surface of the disintegrable article, and the electrons are provided to the disintegrable article via the first and second conductive metals or metal alloys.

* * * * *